US011213727B2

(12) United States Patent
Mizutani

(10) Patent No.: US 11,213,727 B2
(45) Date of Patent: Jan. 4, 2022

(54) GOLF CLUB HEAD

(71) Applicant: SUMITOMO RUBBER INDUSTRIES, LTD., Hyogo (JP)

(72) Inventor: Naruhiro Mizutani, Hyogo (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 0 days.

(21) Appl. No.: 17/079,901

(22) Filed: Oct. 26, 2020

(65) Prior Publication Data

US 2021/0138316 A1 May 13, 2021

(30) Foreign Application Priority Data

Nov. 7, 2019 (JP) ..... JP2019-202065

(51) Int. Cl.
*A63B 53/04* (2015.01)

(52) U.S. Cl.
CPC ..... *A63B 53/0466* (2013.01); *A63B 53/0433* (2020.08); *A63B 2053/0491* (2013.01)

(58) Field of Classification Search
CPC ..... A63B 53/0433; A63B 53/045; A63B 53/0466
USPC ..... 473/324–350
See application file for complete search history.

(56) References Cited

U.S. PATENT DOCUMENTS 4,432,549 A * 2/1984 Zebelean ..... A63B 53/0466 473/346
4,511,145 A * 4/1985 Schmidt ..... A63B 53/04 473/346
4,618,149 A * 10/1986 Maxel ..... A63B 53/04 473/245
5,295,689 A * 3/1994 Lundberg ..... A63B 53/04 473/346
5,380,010 A * 1/1995 Werner ..... A63B 53/0466 473/346
5,839,975 A * 11/1998 Lundberg ..... A63B 60/00 473/346
6,048,278 A * 4/2000 Meyer ..... A63B 53/0466 473/345
7,056,229 B2 * 6/2006 Chen ..... A63B 53/0466 473/346
7,074,136 B2 * 7/2006 Noguchi ..... A63B 53/0466 473/346

(Continued)

FOREIGN PATENT DOCUMENTS

FR 2904232 A1 * 2/2008 ..... A63B 53/0466
JP 04327864 A * 11/1992

(Continued)

*Primary Examiner* — Alvin A Hunter
(74) *Attorney, Agent, or Firm* — Greenblum & Bernstein, P.L.C.

(57) ABSTRACT

A golf club head includes a face portion, a crown portion, a sole portion and a hosel portion. The head includes a head body formed by a metallic material and a cover member formed by a material having a rigidity lower than that of the metallic material forming the head body. The head body includes an opening and a beam part that extends so as to intersect the opening. The opening is covered by the cover member. The beam part includes an inward bending portion that is bent so as to project inward of the head. The head body includes bent portions located at respective two end portions of the beam part.

16 Claims, 9 Drawing Sheets

(56) References Cited

U.S. PATENT DOCUMENTS 7,108,614 B2 * 9/2006 Lo ..... A63B 53/0466 473/345
7,147,198 B2 * 12/2006 Lin ..... B22C 7/02 249/52
7,258,624 B2 * 8/2007 Kobayashi ..... A63B 60/00 473/324
7,497,789 B2 * 3/2009 Burnett ..... A63B 60/02 473/342
7,632,195 B2 * 12/2009 Jorgensen ..... A63B 53/0466 473/345
7,641,568 B2 * 1/2010 Hoffman ..... A63B 53/0466 473/327
7,674,190 B2 * 3/2010 Galloway ..... A63B 60/02 473/345
7,749,104 B2 * 7/2010 Brekke ..... A63B 53/0466 473/345
7,758,453 B2 * 7/2010 Horacek ..... A63B 53/0466 473/345
7,998,000 B2 * 8/2011 Brekke ..... A63B 53/0466 473/345
8,025,591 B2 * 9/2011 De La Cruz ..... A63B 53/0466 473/344
8,147,354 B2 * 4/2012 Hartwell ..... A63B 53/0466 473/345
8,267,808 B2 * 9/2012 De La Cruz ..... A63B 60/00 473/345
8,475,292 B2 * 7/2013 Rahrig ..... A63B 60/00 473/324
8,608,591 B2 * 12/2013 Chao ..... A63B 53/0466 473/345
8,777,778 B2 * 7/2014 Solheim ..... A63B 53/0466 473/346
8,900,070 B1 * 12/2014 Dawson ..... A63B 53/047 473/329
8,926,448 B1 * 1/2015 Ivanova ..... A63B 60/52 473/329
9,101,811 B1 * 8/2015 Goudarzi ..... A63B 60/52
9,174,103 B2 * 11/2015 Curtis ..... A63B 53/0466
9,211,451 B1 * 12/2015 Westrum ..... A63B 60/00
9,770,635 B2 * 9/2017 Motokawa ..... A63B 53/0466
10,413,785 B2 * 9/2019 Akiyama ..... A63B 53/04
10,716,974 B2 * 7/2020 Mizutani ..... A63B 53/0433
10,821,336 B2 * 11/2020 Morales ..... A63B 53/0408
10,835,793 B2 * 11/2020 Knight ..... A63B 60/54
2003/0134692 A1 7/2003 Nakahara et al.
2003/0171162 A1 * 9/2003 Park ..... A63B 53/0466 473/346
2003/0190975 A1 * 10/2003 Fagot ..... A63B 53/0466 473/346
2006/0172818 A1 * 8/2006 Yamamoto ..... A63B 53/0466 473/345
2011/0152004 A1 * 6/2011 Ban ..... A63B 53/0466 473/345
2012/0302369 A1 * 11/2012 Ban ..... A63B 53/04 473/346
2015/0290504 A1 * 10/2015 Li ..... A63B 53/0466 473/346

FOREIGN PATENT DOCUMENTS

JP 2001095957 A * 4/2001
JP 2003-250933 A 9/2003
JP 2005323686 A * 11/2005
JP 2006020817 A * 1/2006
JP 2006020860 A * 1/2006
JP 2013031656 A * 2/2013 ..... A63B 53/045
WO WO-2004101079 A1 * 11/2004 ..... A63B 53/04

* cited by examiner

GOLF CLUB HEAD

The present application claims priority on Patent Application No. 2019-202065 filed in Japan on Nov. 7, 2019. The entire contents of this Japanese Patent Application are hereby incorporated by reference.

BACKGROUND OF THE INVENTION

Field of the Invention

The present disclosure relates to a golf club head.

Description of the Related Art

There has been known a head having a composite structure. JP2003-250933A (US2003/0134692A1) discloses a golf club head that includes: a head body having an opening; and a member made of a fiber reinforced plastic and covering the opening.

SUMMARY OF THE INVENTION

In a head having a composite structure, the rigidity of the head is reduced. The reduced rigidity lowers the pitch of sound at impact and shortens the duration (period of time during which a sound continues) of sound at impact. Such a head cannot attain a good sound at impact. A sound at impact is more than a matter of mere preference. The sound at impact can affect evaluation on the shot. The sound at impact can have an effect on the golf player's state of mind. Consequently, the sound at impact can influence the swing.

The present disclosure provides a head that has a composite structure and is excellent in sound at impact.

According to one aspect, a golf club head includes a face portion, a crown portion, a sole portion, and a hosel portion. The golf club head includes a head body formed by a metallic material and a cover member formed by a material having a rigidity lower than that of the metallic material forming the head body. The head body includes an opening and a beam part that extends so as to intersect the opening. The opening is covered by the cover member. The beam part includes an inward bending portion that is bent so as to project inward of the head. The head body includes bent portions located at respective two end portions of the beam part.

BRIEF DESCRIPTION OF THE DRAWINGS

FIG. 3 shows a bottom view in which a cover member is removed from FIG. 2;

DESCRIPTION OF THE PREFERRED EMBODIMENTS

The following will describe embodiments in detail with appropriate reference to the drawings.

Figure 9:
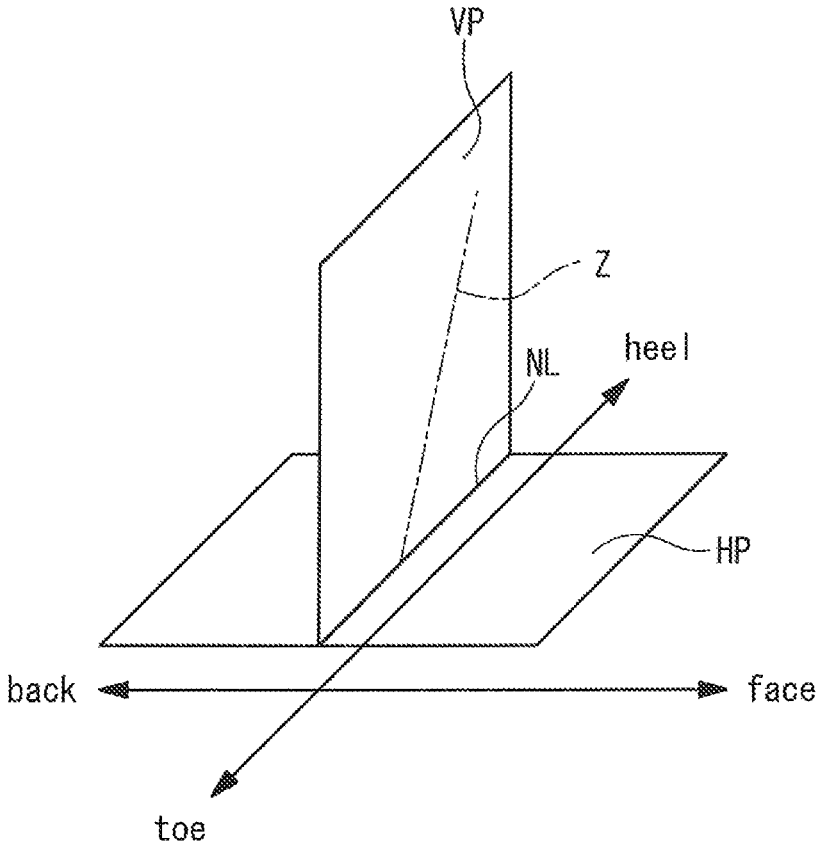
FIG. 9 is a diagram for illustrating a toe-heel direction and a face-back direction.

In the present disclosure, a reference state, a reference perpendicular plane, a face-back direction, a toe-heel direction, and an up-down direction are defined as follows. The reference state is a state where a head is placed at a predetermined lie angle and real loft angle on a horizontal plane HP. As shown in FIG. 9, in the reference state, a center line Z of a hosel hole is contained in a plane VP that is perpendicular to the horizontal plane HP. The plane VP is defined as the reference perpendicular plane. The predetermined lie angle and real loft angle are shown in a catalog of products, for example.

In the present disclosure, the toe-heel direction is the direction of an intersection line NL between the reference perpendicular plane VP and the horizontal plane HP (see FIG. 9).

In the present disclosure, the face-back direction is a direction that is perpendicular to the toe-heel direction and is parallel to the horizontal plane HP.

In the present disclosure, the up-down direction is a direction that is perpendicular to the toe-heel direction and is perpendicular to the face-back direction. In other words, the up-down direction in the present disclosure is a direction perpendicular to the horizontal plane HP.

First Embodiment

Figure 1:
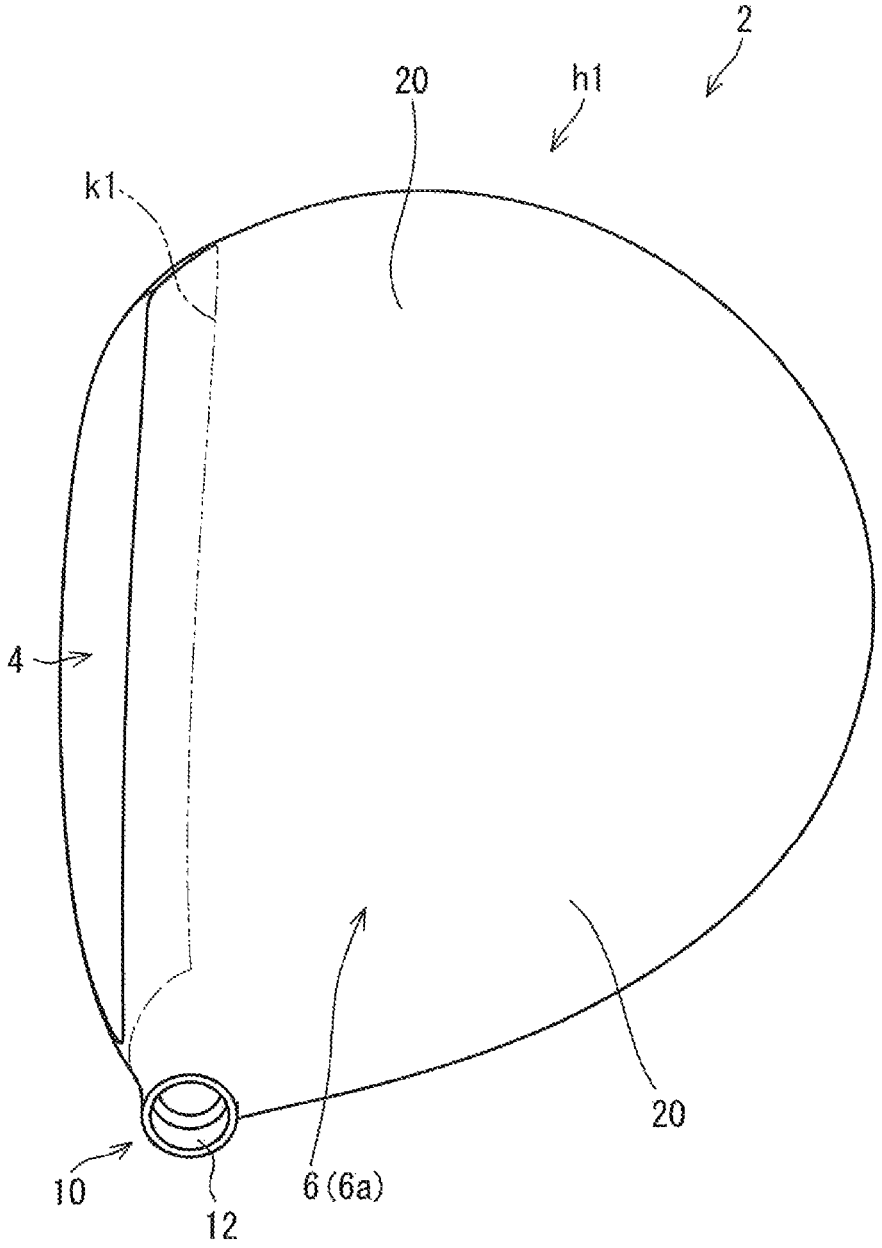
FIG. 1 is a plan view of a head according to a first embodiment.
Figure 2:
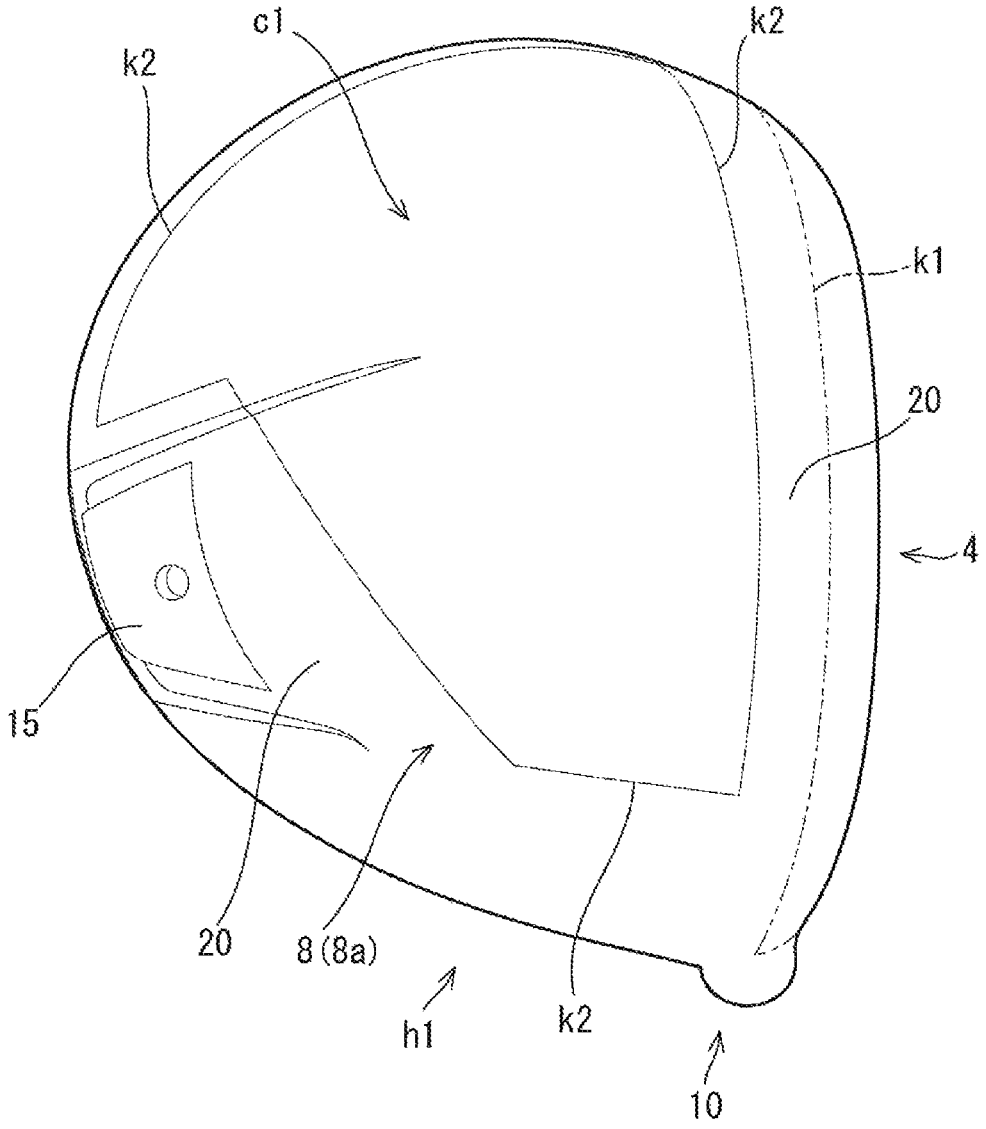
FIG. 2 is a bottom view of the head in FIG. 1.

FIG. 1 is a plan view of a golf club head 2 according to the first embodiment as viewed from a crown side. FIG. 2 is a bottom view of the head 2 as viewed from a sole side. The head 2 includes a face portion 4, a crown portion 6, a sole portion 8, and a hosel portion 10. The face portion 4 includes a hitting face 4*a*. The hitting face 4*a* is the outer surface of the face portion 4. The crown portion 6 includes a crown surface 6*a*. The crown surface 6*a* is the outer surface of the crown portion 6. The sole portion 8 includes a sole surface 8*a*. The sole surface 8*a* is the outer surface of the sole portion 8. The hosel portion 10 includes a hosel hole 12. The head 2 is a wood type head.

As shown in FIG. 2, the head 2 includes a head body h1 and a cover member c1. The head 2 is formed by joining the cover member c1 to the head body h1. In the present embodiment, the cover member c1 is disposed on the sole portion 8. The cover member c1 constitutes a part of the sole surface 8*a*. The sole surface 8*a* is the outer surface of the sole portion 8.

Figure 3:
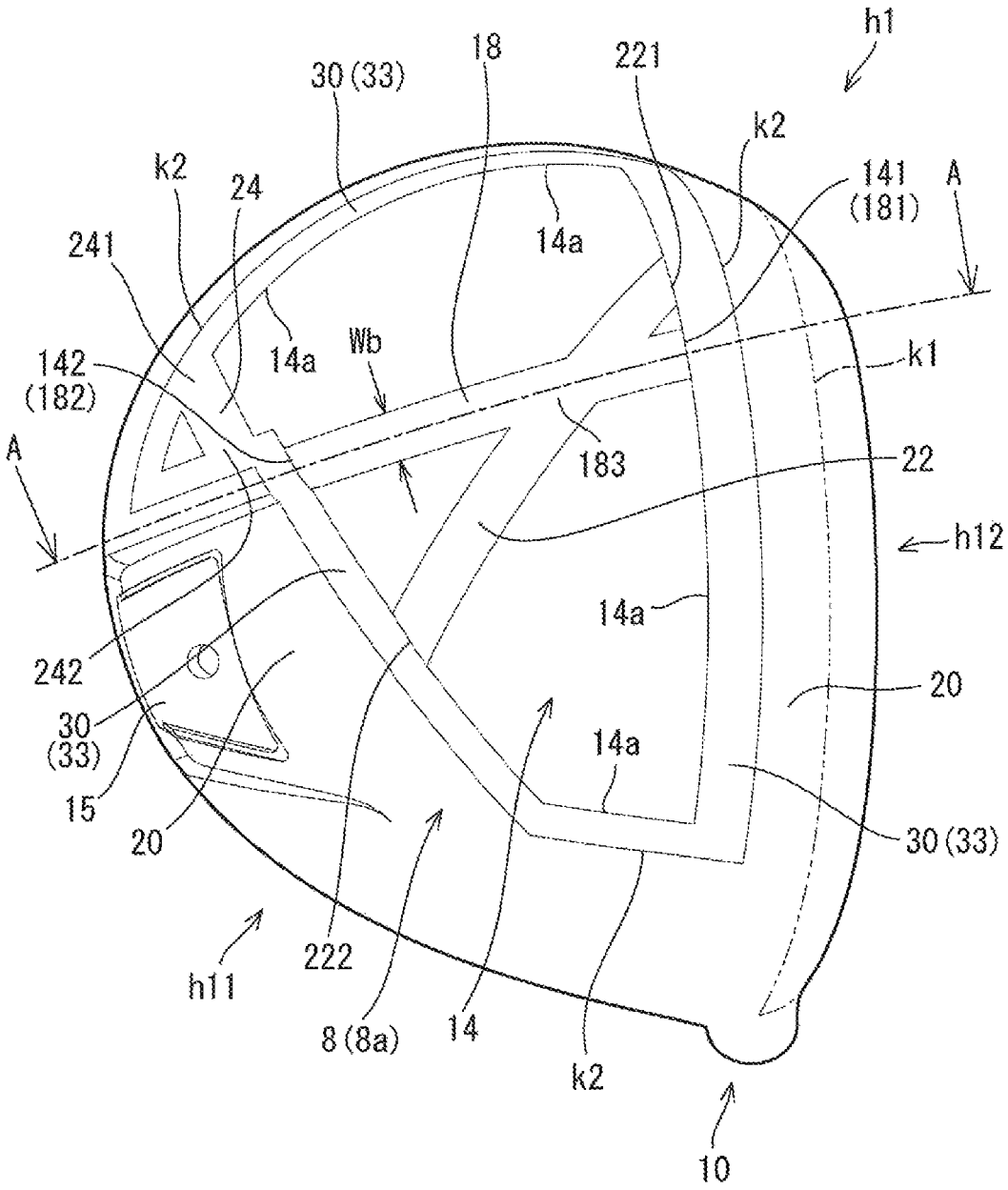
FIG. 3 is a bottom view of a head body used in the head of FIG. 1, in other words.

The head body h1 is formed by joining a face member h12 to a main portion h11. The face member h12 has a cup shape as a whole. The face member h12 forms the entirety of the hitting face 4*a*. Furthermore, the face member h12 constitutes a part of the crown portion 6 and a part of the sole portion 8. The face member h12 is welded to the main portion h11. FIG. 1 to FIG. 3 show a boundary line k1 between the main portion h11 and the face member h12 with a two-dot chain line.

FIG. 2 shows a boundary line k2 on the sole surface 8*a* between the cover member c1 and the head body h1. The boundary line k2 is also the contour line of the cover member c1.

FIG. 3 is a bottom view of the head body h1 as viewed from the sole side. In other words, FIG. 3 is the bottom view of the head 2 from which the cover member c1 is removed. The head body h1 includes an opening 14. The opening 14 is a through hole disposed at a portion that constitutes the sole portion 8 of the head body h1. The opening 14 is the through hole provided in an outer shell part 20 (described later) of the head body h1.

The sole portion 8 includes a weight port 15. A weight member (not shown in drawings) can be detachably attached to the weight port 15.

Figure 4:
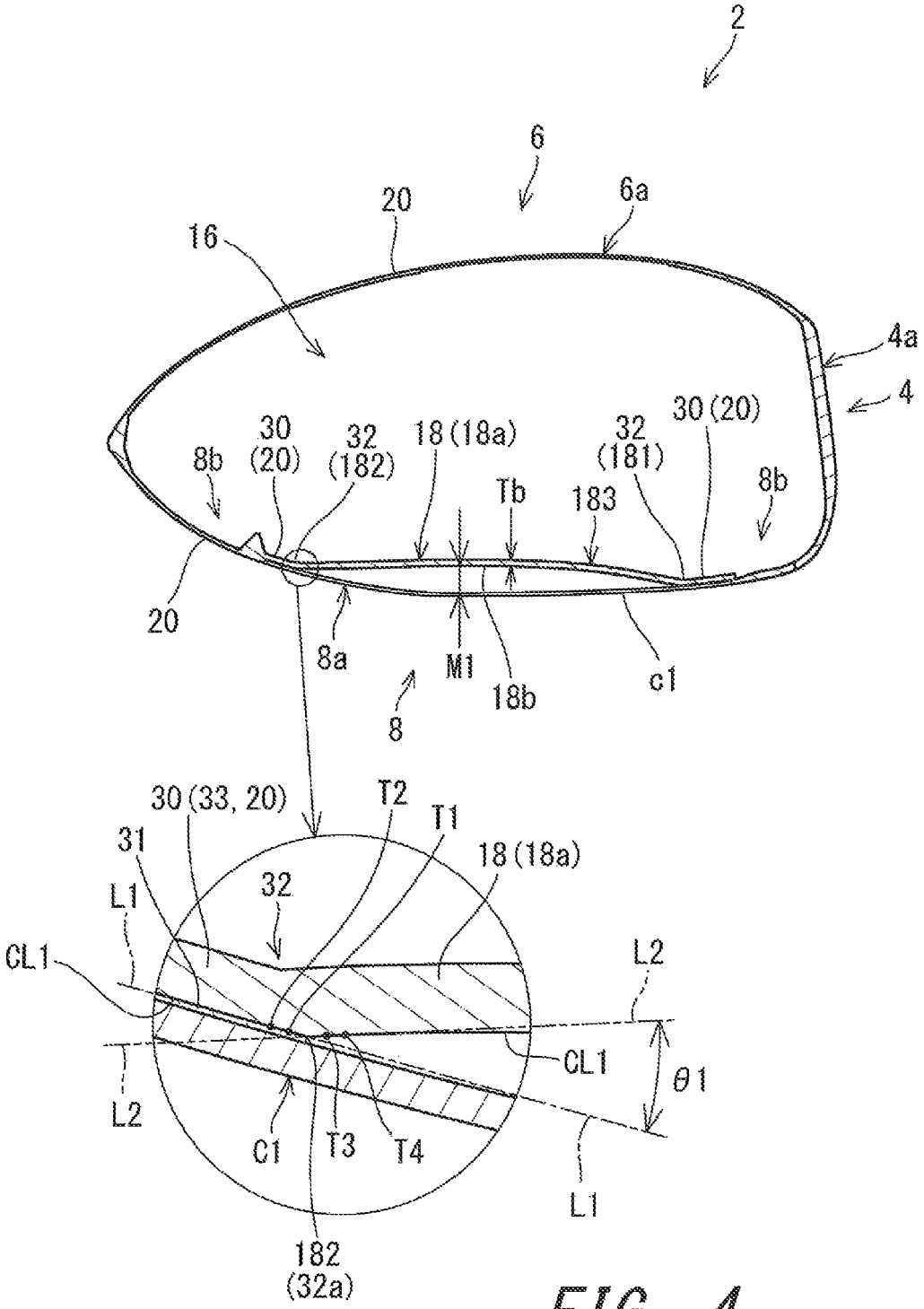
FIG. 4 is a cross-sectional view taken along line A-A in FIG. 3.

FIG. 4 is a cross-sectional view taken along line A-A in FIG. 3. FIG. 4 is a cross-sectional view taken along a center line in a width direction of a first beam part 18. The head 2 includes a hollow portion 16. The head 2 is a hollow head. The inside of a circle in FIG. 4 shows an enlarged view of a part of FIG. 4.

The head body h1 includes the beam part 18 and the outer shell part 20. The outer shell part 20 is a wall that serves as a partition between inside and outside of the head 2. In other words, the outer shell part 20 is a wall that serves as a partition between the outside of the head 2 and the hollow portion 16. The outer surface of the outer shell part 20 forms the hitting face 4*a*, the crown surface 6*a* and the sole surface 8*a*. The beam part 18 has two ends each of which is connected to the outer shell part 20.

As shown in FIG. 3, the beam part 18 intersects the opening 14. In the planer view (FIG. 3) of the head body to which the cover member c1 is not attached, the beam part 18 can be observed inside the opening 14. When the opening 14 is provided on the sole portion 8 as in the present embodiment, the beam part 18 includes a portion located on the upper side of (above) the opening 14. The beam part 18 is located apart from the outer shell part 20. The beam part 18 extends from a first position on the outer shell part 20 to a second position on the outer shell part 20. The beam part 18 extends from a first position on a surrounding portion 33 that surrounds the opening 14 to a second position on the surrounding portion 33 surrounding the opening 14.

As shown in FIG. 3, in the present embodiment, each of the two ends of the beam part 18 is connected to an edge 14*a* of the opening 14. Each of a first end 181 of the beam part 18 and a second end 182 of the beam part 18 is connected to the edge 14*a* of the opening 14. The first end 181 of the beam part 18 is connected to a first position 141 of the edge 14*a*. The second end 182 of the beam part 18 is connected to a second position 142 of the edge 14*a*. The beam part 18 serves as a bridge that connects the first position 141 of the edge 14*a* of the opening 14 and the second position 142 of the edge 14*a* of the opening 14. Alternatively, each of the two ends of the beam part 18 does not have to be connected to the edge of the opening 14. The two ends 181 and 182 of the beam part 18 may be positioned on the inner surface of the surrounding portion 33 (outer shell part 20). That is, the beam part 18 may extend beyond the edge 14*a* of the opening 14 to reach the inner surface of the surrounding portion 33 such that the respective two ends 181 and 182 are located on the inner surface of the surrounding portion 33 (outer shell part 20). When the beam part 18 is positioned on the sole portion 8, the respective two ends 181 and 182 may be located on the inner surface of the sole portion 8. The two ends of the beam part 18 may be connected to respective ribs formed on the inner surface of the surrounding portion 33 (outer shell part 20).

From the viewpoint of enhancing rigidity of the entirety of the head 2, each of the two ends 181 and 182 of the beam part 18 is preferably connected to near the edge 14*a* of the opening 14. From this viewpoint, each of the two ends 181 and 182 is preferably connected to the surrounding portion 33 of the opening 14, and more preferably connected to the edge 14*a* of the opening 14.

In the embodiment of FIG. 3, a plurality of beam parts respectively intersecting the single opening 14 are provided. The head body h1 includes a second beam part 22 that intersects the opening 14 in addition to the above-described beam part (first beam part) 18 intersecting the opening 14. The head body h1 further includes a third beam part 24 that intersects the opening 14.

The first end 181 of the beam part 18 is located at a face side position relative to the second end 182 of the beam part 18. The first end 181 of the beam part 18 is located at a toe side position relative to the second end 182 of the beam part 18.

The beam part 22 has a first end 221 and a second end 222, and the first end 221 is located at a face side position relative to the second end 222. The first end 221 of the beam part 22 is located at a toe side position relative to the second end 222 of the beam part 22.

The first end 221 of the bead portion 22 is located at the toe side position relative to the first end 181 of the beam part 18. The second end 222 of the beam part 22 is located at a heel side position relative to the second end 182 of the beam part 18.

The beam part 24 has a first end 241 and a second end 242, and the first end 241 is located at aback side position relative to the second end 242. The first end 241 of the beam part 24 is located at a toe side position relative to the second end 242 of the beam part 24.

The first beam part 18 and the second beam part 22 intersect with each other. The beam part 18 includes an intersection portion 183 at which the beam part 18 intersects with the beam part 22. The beam part 18 and the beam part 22 are integrated with each other at the intersection portion 183. Although the cross-sectional view shown in FIG. 4 includes the intersection portion 183, the beam part 18 has a substantially constant thickness as a whole. That is, the thickness of the beam part 18 at the intersection portion 183 is substantially the same as the thickness of other portions than the intersection portion 183 in the beam part 18. Although not shown in the drawings, the second beam part 22 also has a substantially constant thickness as a whole including the intersection portion 183. Such an intersection between beam parts enhances rigidities of these beam parts. Rigidities of beam parts can be further enhanced by intersecting beam parts with each other. The third beam part 24 does not intersect with other beam parts. The plurality of beam parts respectively intersecting the single opening 14 further enhance the rigidity of the head body h1. Note that the term "substantially constant" means variation in thickness falls within the scope of ±0.1 mm.

The cover member c1 covers the opening 14. The cover member c1 is joined to the head body h1. The method for achieving this joining is adhesion using an adhesive.

As shown in FIG. 3, the head body h1 includes a support portion 30. The support portion 30 is a part of the outer shell part 20. The support portion 30 is a portion located between the edge 14*a* of the opening 14 and the boundary line k2. The support portion 30 supports the peripheral portion of the cover member c1 from inside the head 2. The surrounding portion 33 of the opening 14 is the support portion 30. The outer surface of the support portion 30 is recessed from the outer surface of the outer shell part 20 other than the support portion 30. Therefore, the support portion 30 forms a stepped-down portion at the boundary between the support portion 30 and the outer shell part 20 surrounding the support portion 30. The contour line of the stepped-down portion coincides with the contour line of the cover member c1 and the boundary line k2. The stepped-down portion has a height that is equal to the thickness of the cover member c1. The stepped-down portion results in no step at the boundary like k2 on the sole surface 8*a*. The outer surface of the support portion 30 is adhered to the inner surface of the cover member c1. The support portion 30 is an adhered portion that is adhered to the cover member c1. As shown in the enlarged portion of FIG. 4, an adhesive layer 31 is formed between the support portion 30 and the cover member c1.

The cover member c1 is a plate-shaped member that is three-dimensionally bent. The outer surface of the cover member c1 forms a convex curved surface. This convex curved surface constitutes a part of the sole surface 8*a*. The inner surface of the cover member c1 forms a concave curved surface. In the present embodiment, the cover member c1 has a substantially constant thickness. Note that the term "substantially constant" means variation in thickness falls within the scope of ±0.1 mm. The cover member c1 has a shape that is projected outward of the head. In the present embodiment, the cover member c1 forms the sole portion 8. The outer surface of the cover member c1 forms the sole surface 8*a*. Excepting a portion that is in contact with the support portion 30, the inner surface of the cover member c1 forms the sole inner surface 8*b*.

As shown in FIG. 4, the beam part 18 is located apart from the cover member c1. The entirety of the beam part 18 is located apart from the cover member c1. The beam part 18 extends in the hollow portion 16 and is disposed apart from the cover member c1. As explained below, alternatively, at least a part of the beam part 18 may be in contact with the cover member c1.

The beam part 18 includes an inward bending portion 18*a* that is bent so as to project inward of the head. In the embodiment of FIG. 4, the entirety of the beam part 18 is the inward bending portion 18*a*. The beam part 18 does not include a portion that is bent so as to project outward of the head. The beam part 18 does not include a portion that extends straight along a straight line. Alternatively, a part of the beam part 18 may be the inward bending portion 18*a*. A part of the beam part 18 may be bent so as to project outward of the head. A part of the beam part 18 may extend straight along a straight line.

In the embodiment of FIG. 4, the entirety of the beam part 18 is located apart from the cover member c1. The entirety of the inward bending portion 18*a* is located apart from the cover member c1. Alternatively, the beam part 18 may be configured such that a part of the beam part 18 is located apart from the cover member c1 and another part of the beam part 18 is in contact with the cover member c1. The beam part 18 may be configured such that a part of the inward bending portion 18*a* is located apart from the cover member c1 and another part of the inward bending portion 18*a* is in contact with the cover member c1.

Although not shown in the drawings, the second beam part 22 is also located apart from the cover member c1. The beam part 22 also includes the inward bending portion. Also in the beam part 22, the entirety of the beam part 22 is the inward bending portion. All the descriptions regarding the beam part 18 also are applicable to the second beam part 22. All the descriptions regarding the beam part 18 are also applicable to the third beam part 24.

As shown in the enlarged portion in FIG. 4, the head body h1 includes a bent portion 32. The bent portion 32 is formed at each of two end portions of the beam part 18.

Each bent portion 32 includes a vertex 32*a* on the outer side of a cross-sectional contour line CL1. The vertex 32*a* is a point having a minimum curvature radius in the cross-sectional contour line CL1, or a vertex of an angle. The cross-sectional contour line CL1 is a cross-sectional line in a specific cross section as described later.

In the present embodiment, the bent portion 32 is formed by the outer shell part 20 and the beam part 18. The boundary between the outer shell part 20 and the beam part 18 is the vertex 32*a*. The bent portion 32 is formed by the surrounding portion 33 and the beam part 18. The boundary between the surrounding portion 33 and the beam part 18 is the vertex 32*a*.

As shown in the enlarged portion in FIG. 4, the vertex 32*a* of the bent portion 32 coincides with the end 182 of the beam part 18. As with this structure, the vertex 32*a* of the other bent portion 32 coincides with the end 181 of the beam part 18. In each bent portion 32, the vertex 32*a* coincides with the edge 14*a* of the opening 14. Alternatively, the beam part 18 may include one or two bent portions 32. In other words, at least one bent portion 32 is formed in the beam part 18. That is, the beam part 18 may be bent to form the at least one bent portion 32.

In the present embodiment, the bent portions 32 are located on respective two end portions of the inward bending portion 18*a*. The inward bending portion 18*a* starts at one bent portion 32 and terminates at the other bent portion 32. The vertexes 32*a* of the bent portions 32 are the respective two end portions of the inward bending portion 18*a*. In this embodiment, the inward bending portion 18*a* can be formed by utilizing bending of the bent portions 32. As a result, an occupation proportion (proportion Ra described later) of the inward bending portion 18*a* can be increased.

Each bent portion 32 is bent so as to project outward of the head. The vertex 32*a* of each bent portion 32 is located at a point (diverging point) from which the head body h1 starts distancing itself from the cover member c1.

Each bent portion 32 is formed by a boundary portion between a first portion that is bent so as to project outward of the head and a second portion that is bent so as to project inward of the head. By this change in projecting direction, the angle of bending of the bent portion 32 is increased. In the present embodiment, the first portion is the outer shell part 20 (support portion 30). In the present embodiment, the second portion is the inward bending portion 18*a*. Alternatively, the first portion and the second portion may be formed in the beam part 18.

A double-pointed arrow θ1 in the enlarged portion of FIG. 4 shows the angle of bending of the bent portion 32. The bending angle θ1 is measured on the cross-sectional contour line CL1 in the specific cross section. The specific cross section means a cross section taken along a plane selected such that the bending angle θ1 is the maximum. The bending angle θ1 is an angle between a first straight line L1 and a second straight line L2. The first straight line L1 is a straight line passing through two points T1 and T2 located on one side relative to the vertex 32*a*. The second straight line L2 is a straight line passing through two points T3 and T4 located on the other side relative to the vertex 32*a*. The point T1 is a point that is located on the cross-sectional contour line CL1 and has a direct distance from the vertex 32*a* of 1.0 mm. The point T2 is a point that is located on the cross-sectional contour line CL1 and has a direct distance from the vertex 32*a* of 3.0 mm. The point T3 is a point that is located on the cross-sectional contour line CL1 and has a direct distance from the vertex 32*a* of 1.0 mm. The point T4 is a point that is located on the cross-sectional contour line CL1 and has a direct distance from the vertex 32*a* of 3.0 mm.

From the viewpoint of increasing the amplitude of vibration of the beam part 18, the bending angle θ1 is preferably greater than or equal to 1°, more preferably greater than or equal to 2°, and still more preferably greater than or equal to 5°. From the viewpoint of setting the curvature radius of the inward bending portion 18*a* within a preferable range, the bending angle θ1 is preferably less than or equal to 45°, more preferably less than or equal to 30°, and still more preferably less than or equal to 20°.

Figure 5:
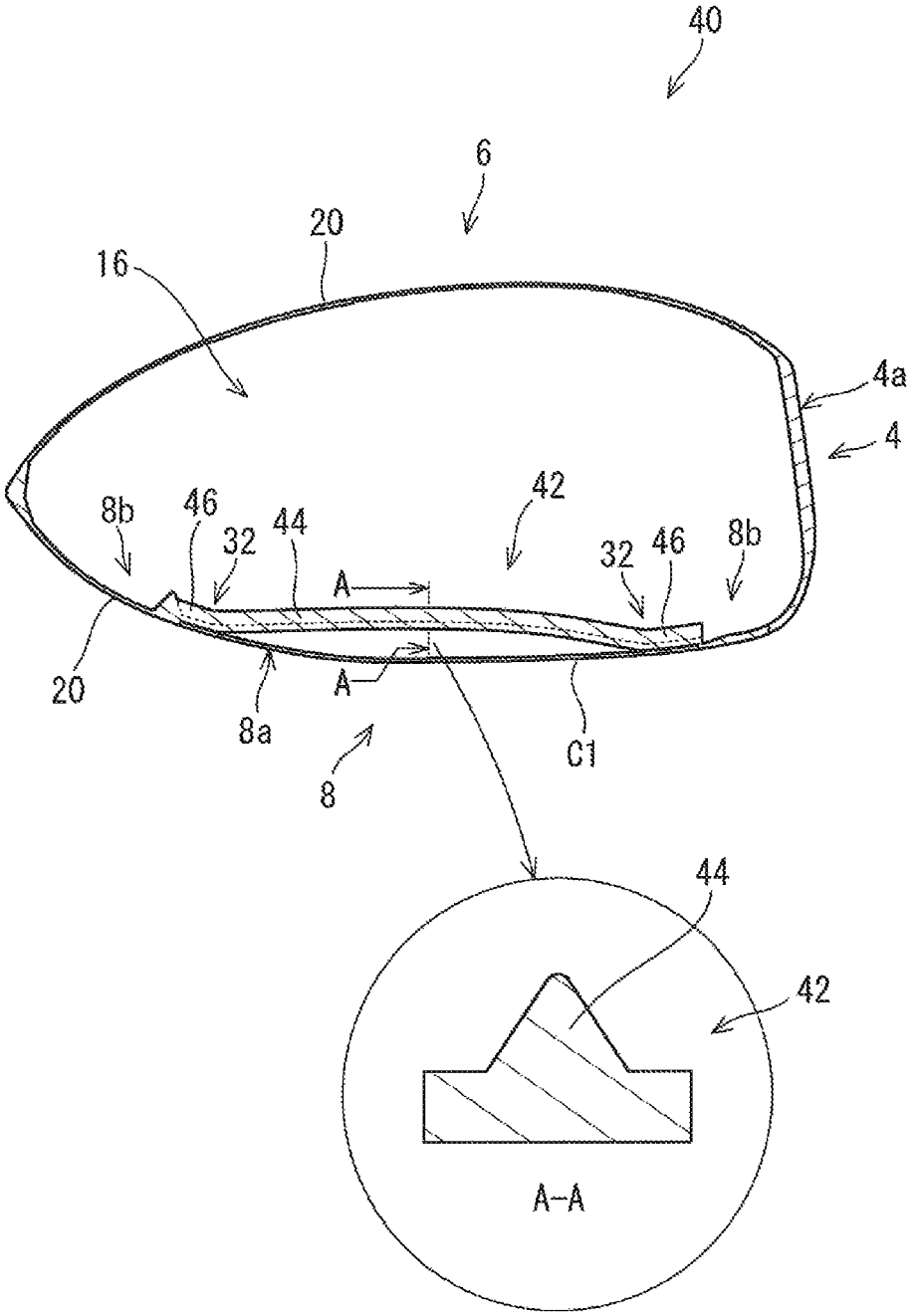
FIG. 5 is a cross-sectional view of a head according to a second embodiment.

FIG. 5 is a cross-sectional view of a head 40 according to a second embodiment. FIG. 5 is the cross-sectional view corresponding to FIG. 4 in the first embodiment.

The head 40 includes a beam part 42. FIG. 5 includes an enlarged portion that is a cross-sectional view of the beam part 42 taken along line A-A in FIG. 5. The beam part 42 includes a rib 44. The rib 44 is formed on the inner surface of the beam part 42. Alternatively, the rib 44 may be formed on the outer surface of the beam part 42. The rib 44 is provided over the entirety of the beam part 42 in the longitudinal direction thereof. Further, the rib 44 includes two end portions that are continuous with respective ribs 46 formed on the inner surface of the outer shell part 20 and that are located at respective positions at which two end portions of the beam part 42 are located. Alternatively, the rib 44 may be provided on a part of the beam part 42 in the longitudinal direction. The rib 44 enhances the rigidity of the beam part 42. Excepting the presence of the ribs 44 and 46, the head 40 is the same as the head 2.

Figure 6:
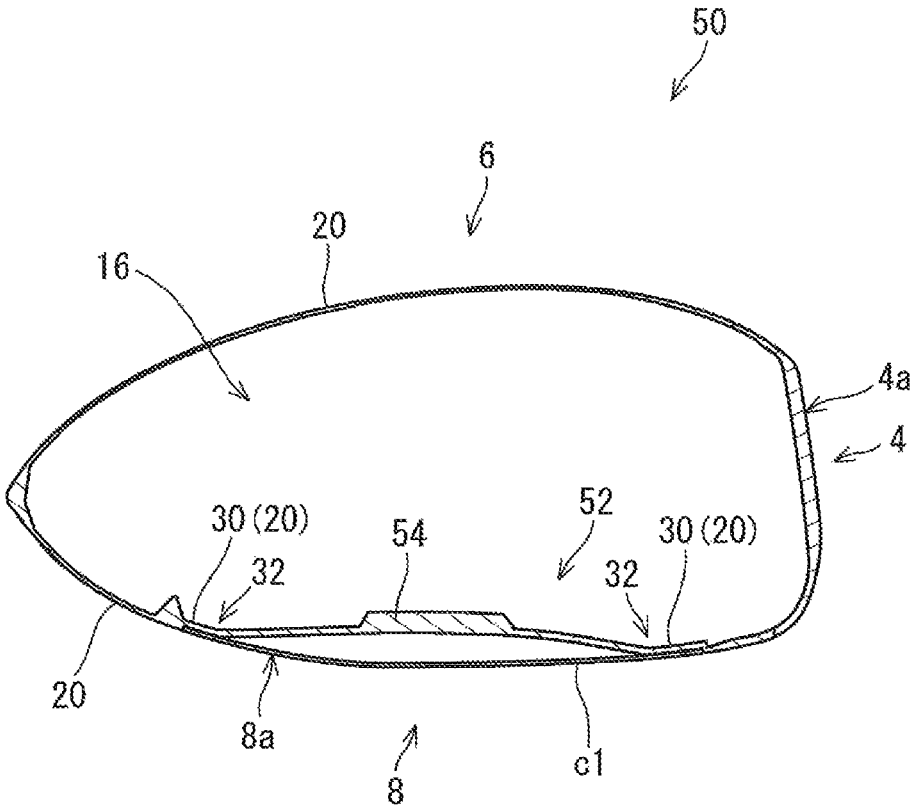
FIG. 6 is a cross-sectional view of a head according to a third embodiment.

FIG. 6 is a cross-sectional view of a head 50 according to a third embodiment. FIG. 6 is the cross-sectional view corresponding to FIG. 4 in the first embodiment.

The head 50 includes a beam part 52. The beam part 52 includes a weight disposing portion 54. The beam part 52 has a partially increased weight in the weight disposing portion 54. The weight disposing portion 54 has a weight per unit length greater than that of other portions of the beam part 52. The "length" in the "unit length" means the length of the beam part 52 in the longitudinal direction. In the present embodiment, the weight disposing portion 54 is formed by partially increasing the thickness of the beam part 52. Alternatively, the weight disposing portion 54 may be formed by incorporating a weight body, for example. Excepting the presence of the weight disposing portion 54, the head 50 is the same as the head 2.

Figure 7:
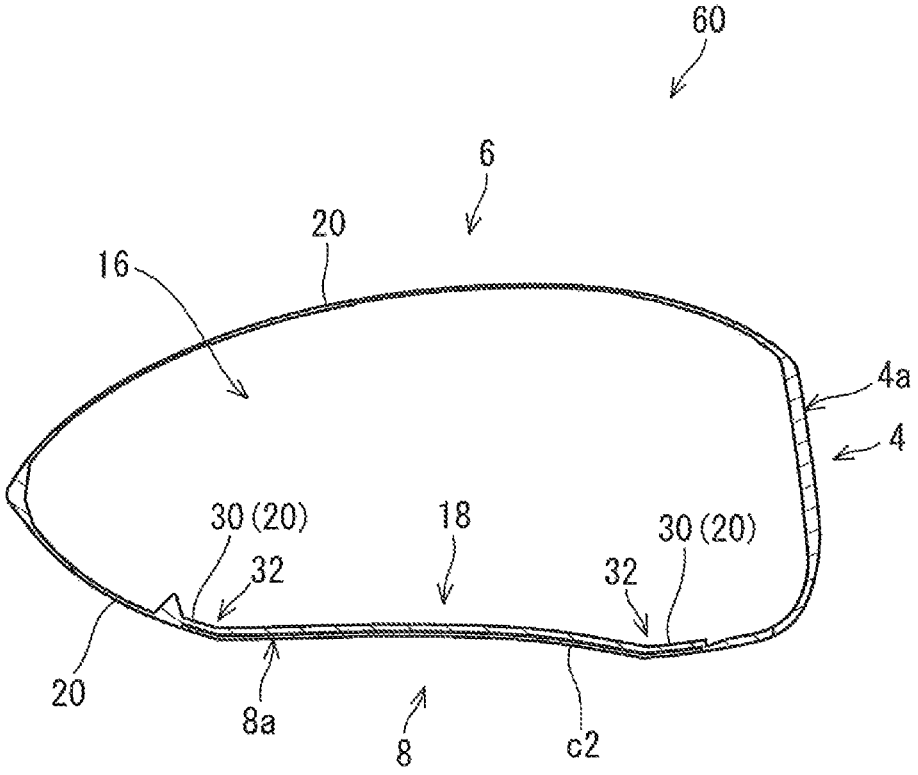
FIG. 7 is a cross-sectional view of a head according to a fourth embodiment.

FIG. 7 is a cross-sectional view of a head 60 according to a fourth embodiment. FIG. 7 is the cross-sectional view corresponding to FIG. 4 in the first embodiment.

The head 60 includes a beam part 18. The beam part 18 is the same as the beam part of the head 2 in the first embodiment. The head 60 includes a head body that is the same as the head body of the head 2. The head 60 includes a cover member c2. The cover member c2 has a shape that is different from the shape of the cover member c1. Excepting the shape of the cover member c2, the head 60 is the same as the head 2.

The cover member c2 has a shape that projects inward of the head. The beam part 18 is in contact with the cover member c2. The entirety of the beam part 18 is in contact with the cover member c2. The entirety of the inward bending portion 18*a* is in contact with the cover member c2. The beam part 18 is adhered to the cover member c2 with an adhesive.

The above-explained embodiments achieve the following advantageous effects.

The rigidity of the material of the cover member is lower than the rigidity of a metallic material of the head body. The head body is not present in the opening, and the opening is covered by the cover member. This structure tends to reduce the rigidity of the head as a whole and to lower the pitch of the sound at impact. Furthermore, this structure tends to shorten the duration (period of time during which a sound continues) of the sound at impact. Such a shortened duration sounds to golf players like a less reverberation of the sound at impact. Golf players prefer a moderately long-lasting sound at impact.

The beam part improves the sound at impact. The beam part vibrates at impact. The beam part tends to vibrate as compared with the outer shell part of the head body. This vibration of the beam part increases the duration of the sound at impact.

The two ends of the beam part are respectively connected to the head body (connected to the surrounding portion of the opening, for example). For this reason, the rigidity of the beam part is enhanced, and the vibration of the beam part is less likely to be damped. As a result, the duration of the sound at impact is increased. In addition, the enhanced rigidity of the beam part makes the sound at impact higher-pitched.

Since the beam part intersects the opening, reduction of the rigidity of the head body which otherwise occurs due to the presence of the opening is prevented. For this reason, a higher-pitched sound at impact is obtained.

In the vibration of the beam part, the beam part is bent alternately in opposite directions. The opposite directions mean a direction of bending in which the beam part is bent so as to project outward of the head and a direction of bending in which the beam part is bent so as to project inward of the head. The inward bending portion exhibits a high rigidity against a deformation that occurs when the inward bending portion is bent in the opposite direction to the original bending direction of the inward bending portion. That is, the inward bending portion has a high rigidity against a bending in which the inward bending portion is bent so as to project outward of the head. For this reason, the inward bending portion has a high rigidity against deformations that occur when the beam part is repeatedly bent in the opposite directions. As a result, the beam part including the inward bending portion achieves a higher-pitched sound at impact.

Bending deformation is likely to occur in the bent portions. The bent portions are formed on the respective two end portions of the beam part, thereby increasing the amplitude of vibration of the beam part and attaining a longer duration of the sound at impact.

When the beam part is not in contact with the cover member, the vibration of the beam part is not suppressed by the cover member, and thus is less likely to be damped. For this reason, a longer duration of the sound at impact is attained (non-contact effect).

When the beam part is in contact with the cover member, the beam part reinforces the cover member having a lower rigidity, thereby enhancing the rigidity of the cover member (see FIG. 7). As a result, the rigidity of the entirety of the head is enhanced, and a higher-pitched sound at impact is attained (contact effect).

When the beam part includes a portion that is in contact with the cover member and a portion that is not in contact with the cover member, both the above-described non-contact effect and contact effect can be simultaneously obtained. In addition, in this case, the ratio between the non-contact effect and the contact effect can be adjusted.

When the beam part is adhered to the cover member, the cover member is further reinforced by the beam part, and thus the rigidity of the cover member is further enhanced. In addition, this structure prevents an abnormal noise that otherwise occurs when a vibrating beam part beats the cover member.

From the viewpoint of lowering the position of the center of gravity of the head, the sole portion usually has a thickness greater than that of the crown. When the opening is formed on the sole portion, a saved weight is increased because of the presence the opening. The saved weight increases the degree of freedom in the design of the head.

In particular, when the two ends of the beam part are connected to the sole portion, the beam part adds its weight to the weight of the sole portion. Therefore, the position of the center of gravity of the head can be lowered.

The specific gravity of the material forming the cover member is preferably lower than the specific gravity of the metallic material forming the head body. In this case, a partial substitution of the head body with the cover member generates a saved weight. This saved weight contributes to increase in the degree of freedom in the design of the head.

As with the embodiment of FIG. 5, when a rib is provided on the beam part, the rigidity of the beam part is enhanced. As a result, a higher-pitched sound at impact is obtained. When this rib is connected to a rib (ribs) provided on the outer shell part of the head body, the rigidity of the beam part is further enhanced.

As with the embodiment of FIG. 6, when a weight disposing portion is provided, the weight disposing portion increases the amplitude of vibration of the beam part. For this reason, the duration (period of time during which vibration continues) of the vibration of the beam part is increased, and such a longer duration of the vibration sounds to golf players like a long-lasting reverberation of the sound at impact.

As shown with the beam part 18 and the beam part 22 in FIG. 3, each beam part may be bent in a planer view. This bending enhances the rigidity of the beam part itself. Alternatively, the beam part may extend along a straight line in the planer view. In this case, the weight of the beam part is saved, which can increase the degree of freedom in the design of the head. When the beam part is provided on the sole portion, the planer view means a bottom view of the head as viewed from the sole side. When the beam part is provided on the crown portion, the planer view means a plan view of the head as viewed from the crown side.

The position of the opening is not limited. For example, the opening may be provided on the crown portion. In this case, the two ends of the beam part are connected to the crown portion of the head body. In this case, the above-described advantageous effects are obtained except the effect brought by providing the opening on the sole portion.

A double-pointed arrow M1 in FIG. 4 shows a maximum distance between the beam part and the cover member. From the viewpoint of suppressing the occurrence of the abnormal noise caused by the vibration of the beam part, the maximum distance M1 is preferably greater than or equal to 1 mm, and more preferably greater than or equal to 2 mm. Considering preferable shapes of the cover member and the inward bending portion, the maximum distance M1 is preferably less than or equal to 5 mm, and more preferably less than or equal to 4 mm. This maximum distance M1 is the maximum value of the distance between the beam part and the cover member. This distance is measured along the up-down direction.

A double-pointed arrow Wb in FIG. 3 shows a width of the beam part. From the viewpoint of the rigidity of the beam part, the width Wb is preferably greater than or equal to 2 mm, more preferably greater than or equal to 3 mm, and still more preferably greater than or equal to 5 mm. From the viewpoint of saving the weight of the beam part, the width Wb is preferably less than or equal to 20 mm, more preferably less than or equal to 15 mm, and still more preferably less than or equal to 12 mm. The width Wb is measured along a direction that is perpendicular to the longitudinal direction of the beam part.

A double-pointed arrow Tb in FIG. 4 shows a thickness of the beam part. From the viewpoint of the rigidity of the beam part, the thickness Tb is preferably greater than or equal to 0.45 mm, more preferably greater than or equal to 0.6 mm, and still more preferably greater than or equal to 0.8 mm. From the viewpoint of saving the weight of the beam part, the thickness Tb is preferably less than or equal to 2.0 mm, more preferably less than or equal to 1.5 mm, and still more preferably less than or equal to 1.2 mm. The thickness Tb is measured along a direction that is perpendicular to a lower surface 18*b* of the beam part.

For increasing the advantageous effect brought by providing the cover member c1, sizes of the cover member c1 and the opening 14 are preferably enlarged. The beam part intersects the opening 14. From this viewpoint, the beam part has a length of preferably greater than or equal to 30 mm, more preferably greater than or equal to 40 mm, and still more preferably greater than or equal to 50 mm. There is a limit in the size of the opening 14 due to restriction on the volume of the head. From this viewpoint, the length of the beam part is preferably less than or equal to 100 mm, more preferably less than or equal to 90 mm, and still more preferably less than or equal to 80 mm. The length of the beam part is measured in the extending direction of the beam part which extends curvedly.

For enhancing the advantageous effect brought by the inward bending portion 18*a*, a proportion Ra (%) of the inward bending portion 18*a* to the beam part 18 is preferably greater. From this viewpoint, the proportion Ra is preferably greater than or equal to 70%, more preferably greater than or equal to 80%, still more preferably greater than or equal to 90%, and yet still more preferably greater than or equal to 95%. The proportion Ra may be 100%. In the embodiment of FIG. 4, the proportion Ra is 100%. The proportion Ra can be calculated by dividing the length of the inward bending portion by the length of the beam part. The length of the inward bending portion is measured along the extending direction of the inward bending portion which extends curvedly. The length of the beam part is measure as described above.

A lightweight cover member c1 increases the degree of freedom in the design of the head. From this viewpoint, the cover member c1 has a thickness of preferably less than or equal to 0.9 mm, more preferably less than or equal to 0.8 mm, and still more preferably less than or equal to 0.7 mm. From the viewpoint of enhancing the rigidity of the cover member c1, the thickness of the cover member c1 is preferably greater than or equal to 0.2 mm, more preferably greater than or equal to 0.3 mm, and still more preferably greater than or equal to 0.4 mm.

The beam part 18 has a center of gravity that is located at a toe-side position relative to the position of the center of gravity of the head 2 (see FIG. 3). The beam part 18 is useful in locating the center of gravity of the head at a toe-side position. Alternatively, the center of gravity of the beam part 18 may be located at a heel-side position relative to the position of the center of gravity of the head 2.

The curvature radius of bending of the inward bending portion 18*a* is not limited. From the viewpoint of enhancing the rigidity of the beam part 18, it is not preferable that the curvature radius of the inward bending portion 18*a* is excessively large or excessively small. As to the lower limit, the curvature radius is preferably greater than or equal to 38.1 mm, more preferably greater than or equal to 127 mm, and still more preferably greater than or equal to 254 mm. As to the upper limit, the curvature radius is preferably less than or equal to 2540 mm, more preferably less than or equal to 1905 mm, and still more preferably less than or equal to 1270 mm. The curvature radius is measured in a cross-sectional view taken along the center line of the beam part 18 in the width direction. The curvature radius can be a curvature radius of the cross-sectional line of the lower surface 18*b* of the beam part 18.

The material of the cover member c1 is different from the material of the head body h1. The material of the cover member c1 can be a resin material, a composite material, or a metallic material. The material of the cover member c1 may be a combination of two or more materials selected from the group consisting of a resin material, a composite material, and a metallic material. Examples of the resin material include an epoxy resin, a polycarbonate resin, a polyamide resin, and an ABS resin (acrylonitrile butadiene styrene resin). Examples of the composite material include a fiber reinforced plastic. Examples of the fiber reinforced plastic include carbon fiber reinforced plastic. From the viewpoint of strength, the carbon fiber reinforced plastic is preferable. Examples of the metallic material include pure titanium, a titanium alloy, a steel, an aluminum alloy, and a magnesium alloy. Examples of the steel include maraging steel, stainless steel, and soft iron (a carbon steel having a carbon content of less than or equal to 0.3% by weight). When the metallic material is selected as the cover member c1, a metallic material having a lower rigidity than the rigidity of the metallic material of the head body is selected as the metallic material for the cover member c1. In the above embodiments, the material forming the cover member c1 is carbon fiber reinforced plastic.

Examples of a metallic material forming the head body h1 include pure titanium, a titanium alloy, a steel, an aluminum alloy, and a magnesium alloy. Examples of the steel include maraging steel, stainless steel, and soft iron (a carbon steel having a carbon content of less than or equal to 0.3% by weight). In the above embodiments, the material forming the head body h1 is a titanium alloy. Alternatively, the head body h1 may be formed by two or more kinds of metallic materials.

Alternatively, the head body h1 may be formed by joining two or more metallic members to each other. The method of this joining is preferably welding.

As described above, the rigidity of the material forming the cover member c1 is lower than the rigidity of the metallic material forming the head body h1. The rigidity can be determined by Young's modulus. The Young's modulus of the material forming the cover member c1 is lower than the Young's modulus of the metallic material forming the head body h1.

Values of Young's moduli for commonly used materials are known. Young's moduli of the materials are compared based on the known values of Young's moduli. When the Young's modulus of a certain material is unknown, or magnitude relationship between Young's moduli of materials is unclear, those Young's moduli can be specified by the following measurement method.

Figure 8:
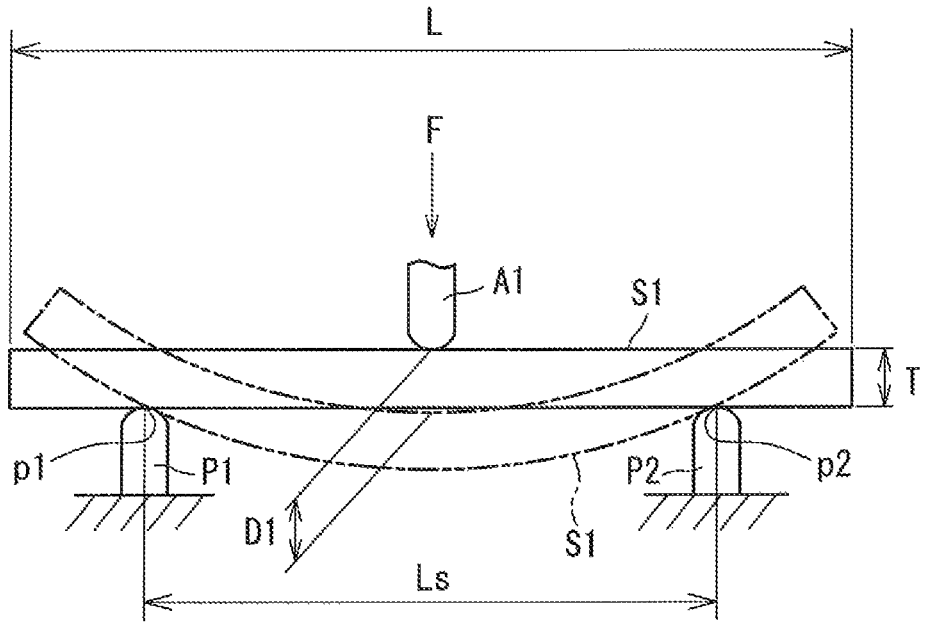
FIG. 8 is a schematic diagram showing a method for measuring a Young's modulus.

FIG. 8 is a schematic diagram showing a method for measuring the Young's modulus. No. 3 test piece according to bend test pieces for metallic materials in JIS 22204 is used in this measurement as a test piece S1. The test piece S1 has a cross-sectional shape of a rectangle. The test piece S1 has dimensions of 20 mm in width W (not shown), and 3.0 mm in thickness T. The test piece S1 has a length L of 150 mm. The test piece S1 is placed on two supports P1 and P2 arranged such that a span Ls between the two supports is 30 mm. The test piece S1 is laid horizontally. A bending amount D1 (mm) is measured when a load F (N) is applied to a position dividing the distance between support points p1 and p2 into two equal parts. The load F is 100 N. The load F is applied with an indenter A1. As a testing device, "Intesco (load cell 2 tons)" produced by Intesco Co., Ltd. can be used. The measurement is performed in compliance with JIS 22248. Young's modulus Yg (GPa) is calculated by the following formula:

$$Yg=[(Ls^3\times F)/(4\times W\times T^3\times D1)]\times 10^{-3}$$

The Young's modulus of a material that cannot be measured by the above method can be measured by a flexural resonance method. In the flexural resonance method, a test piece having dimensions of 10 mm×60 mm×2 mm is used, and the Young's modulus can be measured at temperature of 20° C.

When the material has anisotropy, the test piece is prepared such that the Young's modulus is the maximum.

A head having a large volume and including a large hollow portion 16 has a big sound at impact. In this case, the influence of the sound at impact to the golf player is great. In addition, when the opening 14 is large, the advantageous effect brought by the beam part 18 is also great. From this viewpoint, the head 2 has a volume of preferably greater than or equal to 300 cc, more preferably greater than or equal to 350 cc, still more preferably greater than or equal to 400 cc, and yet still more preferably greater than or equal to 420 cc. From the viewpoint of golf rules, the head volume is preferably less than or equal to 470 cc, and more preferably less than or equal to 460 cc.

The following clauses are disclosed regarding the above-described embodiments.

[Clause 1]

A golf club head comprising:

a face portion;

a crown portion;

a sole portion; and a hosel portion, wherein the golf club head includes a head body formed by a metallic material, and a cover member formed by a material having a rigidity lower than that of the metallic material forming the head body;

the head body includes an opening and a beam part that extends so as to intersect the opening, the opening is covered by the cover member, the beam part includes an inward bending portion that is bent so as to project inward of the golf club head, and the head body includes bent portions located at respective two end portions of the beam part.

[Clause 2]

The golf club head according to clause 1, wherein the material forming the cover member is at least one selected from the group consisting of a resin material, a composite material, and a metallic material.

[Clause 3]

The golf club head according to clause 1 or 2, wherein the material forming the cover member has a specific gravity that is lower than a specific gravity of the metallic material forming the head body.

[Clause 4]

The golf club head according to clause 3, wherein the opening is formed on the sole portion.

[Clause 5]

The golf club head according to any one of clauses 1 to 4, wherein the beam part includes a portion that is located apart from the cover member.

[Clause 6]

The golf club head according to clause 5, wherein an entirety of the beam part is located apart from the cover member.

[Clause 7]

The golf club head according to any one of clauses 1 to 4, wherein the beam part includes a portion that is in contact with the cover member.

[Clause 8]

The golf club head according to clause 7, wherein an entirety of the beam part is in contact with the cover member.

[Clause 9] The golf club head according to any one of clauses 1 to 8, wherein the beam part includes a weight disposing portion formed by partially increasing weight of the beam part.

LIST OF REFERENCE NUMERALS

2, 40, 50, 60 Head
4 Face portion
4*a* Hitting face
6 Crown portion
8 Sole portion
10 Hosel portion
14 Opening
14*a* Edge of opening
141 First position of edge of opening
142 Second position of edge of opening
16 Hollow portion
18 Beam part (first beam part)
18*a* Inward bending portion
181 First end of beam part
182 Second end of beam part
20 Outer shell part
22 Beam part (second beam part)
24 Beam part (third beam part)
30 Support portion
32 bent portion
c1 Cover member The above descriptions are merely illustrative and various modifications can be made without departing from the principles of the present disclosure.

What is claimed is:

1. A golf club head comprising:
a face portion;
a crown portion;
a sole portion; and
a hosel portion, wherein
the golf club head includes a head body formed by a metallic material, and a cover member formed by a material having a rigidity lower than a rigidity of the metallic material forming the head body,
the head body includes an opening and a beam part that extends so as to intersect the opening,
the opening is covered by the cover member,
the beam part includes an inward bending portion that is bent so as to project inward of the golf club head, and
the head body includes bent portions, located at respective two end portions of the beam part, that are each bent so as to project outward of the golf club head.

2. The golf club head according to claim 1, wherein the material forming the cover member is at least one selected from the group consisting of a resin material, a composite material, and a metallic material.

3. The golf club head according to claim 1, wherein the material forming the cover member has a specific gravity that is lower than a specific gravity of the metallic material forming the head body.

4. The golf club head according to claim 3, wherein the opening is formed on the sole portion.

5. The golf club head according to claim 1, wherein the beam part includes a portion that is located apart from the cover member.

6. The golf club head according to claim 5, wherein an entirety of the beam part is located apart from the cover member.

7. The golf club head according to claim 1, wherein
the head body includes a surrounding portion that surrounds the opening, and
the beam part extends from a first position on the surrounding portion to a second position on the surrounding portion.

8. The golf club head according to claim 7, wherein
the head body includes a support portion that supports a peripheral portion of the cover member from inside the golf club head, and the surrounding portion surrounding the opening forms the support portion.

9. The golf club head according to claim 1, wherein
the beam part includes a first end that is connected to a first position of an edge of the opening, and a second end that is connected to a second position of the edge of the opening.

10. The golf club head according to claim 1, wherein the bent portions are bent at an angle of greater than or equal to 1 degree and less than or equal to 45 degrees.

11. The golf club head according to claim 1, wherein the bent portions are bent at an angle of greater than or equal to 1 degree and less than or equal to 30 degrees.

12. The golf club head according to claim 1, wherein the beam part includes a first beam part and a second beam part intersecting the first beam part.

13. The golf club head according to claim 12, wherein the second beam part intersects the opening.

14. A golf club head comprising:
a face portion;
a crown portion;
a sole portion; and
a hosel portion, wherein
the golf club head includes a head body formed by a metallic material, and a cover member formed by a material having a rigidity lower than a rigidity of the metallic material forming the head body,
the head body includes an opening and a beam part that extends so as to intersect the opening,
the opening is covered by the cover member,
the beam part includes an inward bending portion that is bent so as to project inward of the golf club head,
the head body includes bent portions located at respective two end portions of the beam part, and
the beam part includes a portion that is in contact with the cover member.

15. The golf club head according to claim 14, wherein an entirety of the beam part is in contact with the cover member.

16. A golf club head comprising:

a face portion;

a crown portion;

a sole portion; and a hosel portion, wherein the golf club head includes a head body formed by a metallic material, and a cover member formed by a material having a rigidity lower than a rigidity of the metallic material forming the head body, the head body includes an opening and a beam part that extends so as to intersect the opening, the opening is covered by the cover member, the beam part includes an inward bending portion that is bent so as to project inward of the golf club head, the head body includes bent portions located at respective two end portions of the beam part, and the beam part includes a weight disposing portion formed by partially increasing weight of the beam part.

* * * * *